US006142072A

United States Patent [19]

Rudewitz et al.

[11] Patent Number: 6,142,072

[45] Date of Patent: Nov. 7, 2000

[54] ADJUSTABLE SUSPENSION FOR A PRINTING UNIT GUARD

[75] Inventors: Stephan Rudewitz, Walldorf; Rüdiger Böhm, Schwetzingen, both of Germany

[73] Assignee: Heidelberger Druckmaschinen AG, Heidelberg, Germany

[21] Appl. No.: 09/243,347

[22] Filed: Feb. 1, 1999

[30] Foreign Application Priority Data

Jan. 30, 1998 [DE] Germany ..... 198 03 726

[51] Int. Cl.[7] ..... B41F 1/64

[52] U.S. Cl. ..... 101/216; 101/477

[58] Field of Search ..... 101/212, 216, 101/382.1, 383, 415.1, 477, 480

[56] References Cited

U.S. PATENT DOCUMENTS

| | | | |
|---|---|---|---|
| 4,577,671 | 3/1986 | Stephan | 164/401 |
| 5,003,889 | 4/1991 | Glunz et al. . | |
| 5,289,773 | 3/1994 | Saito et al. . | |
| 5,289,775 | 3/1994 | Spiegel et al. . | |
| 5,440,988 | 8/1995 | Ito | 101/477 |
| 5,460,092 | 10/1995 | Beisel et al. . | |
| 5,487,336 | 1/1996 | Simeth | 101/216 |
| 5,537,926 | 7/1996 | Beisel et al. | 101/477 |
| 5,575,212 | 11/1996 | Moser et al. | 101/477 |
| 5,649,487 | 7/1997 | Zuber . | |
| 5,816,153 | 10/1998 | Zuber | 101/216 |

FOREIGN PATENT DOCUMENTS

| | | |
|---|---|---|
| 0 384 385 A2 | 8/1990 | European Pat. Off. . |
| 0 673 765 A1 | 9/1995 | European Pat. Off. . |
| 0 710 554 A2 | 5/1996 | European Pat. Off. . |
| 44 02 158 C1 | 2/1995 | Germany . |
| 41 40 413 C2 | 3/1995 | Germany . |
| 43 44 090 A1 | 6/1995 | Germany . |
| 2 309 667 | 8/1997 | United Kingdom . |

*Primary Examiner*—Ren Yan
*Attorney, Agent, or Firm*—Herbert L. Lerner; Laurence A. Greenberg; Werner H. Stemer

[57] ABSTRACT

An adjustable suspension for a printing unit guard on a printing unit, having guides and at least one rope or chain pull assembly, on both sides of the guard, for performing an adjusting movement, includes at least one deflecting roller, and at least one counterweight connecting the at least one rope or chain pull assembly via the at least one deflecting roller to the at least one counterweight, the counterweight having a mass which is tared or calibrated for a virtually force-free adjustment of the printing unit guard.

17 Claims, 3 Drawing Sheets

ADJUSTABLE SUSPENSION FOR A PRINTING UNIT GUARD

BACKGROUND OF THE INVENTION

Field of the Invention

The invention relates to an adjustable suspension for a printing unit guard on a printing unit, vertical guides and at least one rope or chain pull assembly for the adjusting movement being provided on both sides of the printing unit guard.

Adjustable suspensions of this type for a printing unit guard serve for exposing the printing units so that cleaning, servicing or repair work can be carried out.

The published European Patent Document EP 0 710 554 A2 discloses an adjustable suspension of the type mentioned in the introduction hereto, wherein the adjusting movement is produced by a pneumatic cylinder and, in order to perform a vertical movement, is transmitted via a multiplicity of rollers to a printing plate changer which also serves as a printing unit guard. In this adjustable suspension, adjusting energy has to be available to an appreciable extent in order to perform the necessary adjusting movements, and manual actuation is ruled out. Moreover, the rope guides with a large number of rollers are complicated and costly, involve a high outlay and take up valuable space.

SUMMARY OF THE INVENTION

It is accordingly an object of the invention to provide an adjustable suspension for a printing unit guard of the type mentioned in the introduction hereto, wherein adjusting movements can be performed in a simple manner and by least possible drive energy, that is, even manually.

With the foregoing and other objects in view, there is provided, in accordance with the invention, an adjustable suspension for a printing unit guard on a printing unit, having guides and at least one rope or chain pull assembly, i.e., at least one line assembly, on both sides of the guard, for performing an adjusting movement, comprising at least one deflecting roller, and at least one counterweight connecting the at least one rope or chain pull assembly via the at least one deflecting roller to the at least one counterweight, the counterweight having a mass which is tared or calibrated for a virtually force-free adjustment of the printing unit guard.

In accordance with another feature of the invention, the one rope or chain pull assembly, the one deflecting roller and the one counterweight are arranged, respectively, both on the drive side and on the operator side of the printing unit.

In accordance with a further feature of the invention, the printing unit guard is formed as a printing plate changer and is capable of being detained in position for the printing plate change.

In accordance with an added feature of the invention, the printing unit guard is detainable in at least one standby position.

In accordance with an additional feature of the invention, the printing unit guard is manually adjustable, the taring of the counterweight mass being such that the printing unit guard is able to dwell in any desired position.

In accordance with yet another feature of the invention, the adjustable suspension includes a drive for performing the adjustment, the drive having very low drive energy for overcoming friction.

In accordance with yet a further feature of the invention, the adjustable suspension includes at least one locking bolt on at least one of the drive side and the operator side of the printing unit guard, and at least one sensor for detecting a detention position of the guard and for activating a locking mechanism for the locking bolt.

In accordance with yet an added feature of the invention, the printing unit guard is equipped with at least one servicing flap for accessing a performance of maintenance and cleaning work on at least one of the printing unit and a printing plate changer.

In accordance with yet an additional feature of the invention, the adjustable suspension includes a pivot bearing on the printing unit guard, the printing unit guard being articulated at a lower end thereof on the printing unit by the pivot bearing and being pivotable, with an upper region thereof, such a distance away from the printing unit that it is possible for an inking unit thereof to be cleaned and maintained when the ink fountain of the inking unit is thrown off from an ink duct roller of the inking unit.

In accordance with still another feature of the invention, the adjustable suspension includes a sensor provided for detecting the pivoted-away printing unit guard.

In accordance with still a further feature of the invention, the adjustable suspension includes a sensor for detecting a lowermost vertical position of the printing unit guard.

In accordance with still an added feature of the invention, the adjustable suspension includes a switching logic for at least one of clearing the printing unit for printing, and of changing printing plates, in a lowermost vertical position and in a pivoted-to state.

In accordance with still an additional feature of the invention, the adjustable suspension includes a switching logic for clearing the printing unit for a maintenance and cleaning mode, in a lowermost vertical position and in the pivoted-away state.

In accordance with another feature of the invention, the adjustable suspension includes at least one support plate for stabilizing the upper region of the printing unit guard.

In accordance with a further feature of the invention, the adjustable suspension includes a stop for limiting pivoting-away of the printing unit guard.

In accordance with an added feature of the invention, the adjustable suspension includes fixed guide parts connecting the guides, via pivot bearings located at the bottom thereof and via releasable detaining devices disposed in an upper region thereof, to the printing unit.

In accordance with an additional feature of the invention, the adjustable suspension includes at least one coupling connecting the printing unit guard to the ink fountain for pivoting the printing unit guard conjointly with an adjustment of the ink fountain.

In accordance with yet another feature of the invention, the coupling is adjustable.

In accordance with yet a further feature of the invention, the coupling includes two parts formed of threaded bolts with a left-hand and a right-hand thread, and of a nut connecting the threaded bolts, the nut likewise having a left-hand and a right-hand thread.

In accordance with yet an added feature of the invention, the coupling is adjustable via a rotatable, yet fixable eccentric bolt.

In accordance with yet an additional feature of the invention, the adjustable suspension includes a sensor for detecting a throw of the ink fountain on the ink duct roller and also the position of the printing unit guard therewith.

In accordance with still another feature of the invention, the guides are connected to the printing unit via pivot bearings.

In accordance with still a further feature of the invention, the guides are telescoping guides.

In accordance with still an added feature of the invention, two lateral support plates serve for stabilizing the telescoping guides.

In accordance with a concomitant feature of the invention, the printing unit guard is a printing plate changer.

A suspension of the type defined hereinbefore has a simple construction and functions reliably. If there is good counterbalancing, it is merely necessary to overcome the frictional forces which, moreover, can be kept minimal if, for example, the guides are produced from easily slidable material or are provided with rolling bodies. The ease of movement achieved is so good that the printing unit guard can be adjusted manually by an operator without difficulty. Should automatic adjustment be desired, very little drive energy is sufficient for overcoming friction.

The device according to the invention is particularly expedient when a printing plate changer serves as a printing unit guard, because the changer has a greater weight and positions have to be approached exactly.

Advantageously, the adjustable suspension is constructed in such a way that a rope or chain pull assembly, a deflecting roller and a counterweight are arranged in each case both on the drive side and on the operator side of the printing unit. This ensures a symmetric application of force and therefore a uniform adjusting movement. It is, of course, also possible, however, to provide a plurality of deflecting rollers, in order, by a pulley block effect, to reduce the counterweights or, in an embodiment with only one rope or chain pull assembly, to reduce the single counterweight.

In order to preserve the operating positions approached in each case, the printing unit guard, particularly when it is a printing plate changer, should be capable of being detained in the desired positions. A printing plate changer should be capable of being detained in its position for the printing plate change, or in one or more standby positions. When a printing plate is being changed, assurance is thereby provided that an exact position is assumed and maintained. As regards the standby positions, assurance is provided that the printing plate changer or printing unit guard located overhead does not descend while work is being carried out on the printing unit.

If the printing unit guard is adjusted manually, counterbalancing can be such that the printing unit guard dwells in any desired position during adjustment.

The printing unit guard can be detained in many different ways: it may be detained in a specific position, such as that of the printing plate changer during a printing plate change, or in any desired position. Engaging bolts, catches, clamping or braking devices may be provided correspondingly. In one embodiment of such a detaining device, at least one locking bolt is provided in each case on the drive side and/or on the operator side of the printing unit guard, and the detention position can be detected and a locking mechanism can be activated by at least one sensor.

The possibility of rapid access to the printing unit is expedient for servicing, maintenance and cleaning work. For this purpose, it is proposed, in accordance with the invention, that the printing unit guard have at least one servicing flap. Access for work on a printing plate changer itself is, of course, also possible thereby.

One location on the printing unit to which the operators must have frequent and easy access is the inking unit. For cleaning and maintenance, the ink fountain is capable of being thrown off from the inking roller, but, in this case, emerges from the front side of the printing unit. Because the printing unit guard should be as close as possible to the printing unit for reasons of space, the space required for working on the inking unit must be provided by an adjustment of the printing unit guard.

The published European Patent Document EP 0,710,554 A2 mentioned in the introduction hereto provides a solution for this problem, in that the complicated mechanism described for vertical adjustment with the aid of the pneumatic cylinder and of telescopic rails arranged on both sides moves a printing plate changer so far upwardly that it is suspended above the printing unit. In addition to the high mechanical outlay and the need for considerable additional energy, this also has a disadvantage in that there has to be sufficient space available above the press and in that the long adjustment travel requires a correspondingly long adjusting time.

In order to avoid these disadvantages, there is proposed for the adjustable suspension according to the invention, for a printing unit guard, in particular for a printing plate changer, that the printing unit guard be articulated at its lower end on the printing unit by a pivot bearing and, with its upper region, be pivotable so far away from the printing unit that it is possible for the inking unit to be cleaned and maintained when the ink fountain is thrown off from the ink fountain roller.

By this adjusting movement of the printing unit guard which can be carried out in a simple way, the inking unit can be exposed with the least possible expenditure of energy, that is to say even directly manually. It is thus possible to clean the ink fountain, metering elements and inking roller quickly, and an ink change can also be performed quickly.

In one proposal, a sensor is provided, which detects the printing unit guard that has been pivoted-away. Moreover, a sensor may be provided which detects the lowermost vertical position of the printing unit guard.

For processing the signals, a switching logic is provided which clears the printing unit for printing in the lowermost vertical position and in the pivoted-to state, as opposed to the pivoted-away state. During printing, the printing plate changer also serves as a printing unit guard, in order to cover the rotating cylinders for reasons of work safety. The printing press is also cleared in the positions for the printing plate change. For this purpose, however, the corresponding settings of the printing plate changer are additionally required.

A further switching logic is proposed, which clears the printing unit in the lowermost vertical position and in the pivoted-away state, for example for a maintenance and cleaning mode. The reason is that the cleaning of the inking unit must take place, in part, while the press is running. This cleaning mode occurs when the printing unit guard covers the rotating cylinders by virtue of its lowermost vertical position, but makes the inking unit accessible for this work by virtue of the pivoted-away state. One advantage, as compared with the prior art having the printing plate changer moved away completely, is that there is protection from the rotating cylinders, but the inking unit is nevertheless fully accessible.

The fundamental inventive concept of pivoting the printing unit guard away for work on the inking unit can be implemented in various ways: in one proposal, at least one support plate stabilizes the printing unit guard in the upper region and, if necessary, also guides it. It is expedient, moreover, if the ability of the printing unit guard to be pivoted away is limited by a stop. The support plate and stop may, of course, be constructed as one component with both functions, and they are expediently arranged both on the drive side and on the operator side. High stability is achieved thereby.

There are also various possibilities for linking the mechanism for the vertical guides to the mechanism for providing the printing unit guard with the capability of being pivoted away:

In a first proposal, the guides are connected to the printing unit by fixed guide parts, and guide parts displaceable therein are connected to the printing unit guard via pivot bearings arranged at the bottom and via a releasable detaining device arranged in the upper region. In an additional development, the pivoting of the printed unit guard takes place conjointly with an adjustment of the ink fountain, the printing unit guard beings connected to the ink fountain by at least one link or coupling. This embodiment has the advantage of simple access to the inking unit. It is necessary merely to release the detaining device between the printing unit guard and the guides, and the printing unit guard can thereafter be adjusted conjointly with the ink fountain. In this case, the ink fountain may be displaced or likewise pivoted in order to be thrown off from the ink fountain roller.

A coupling or link, or preferably a one thereof on each side of the press, may be articulated in each case on the printing unit guard and on the ink fountain by a respective link joint. Expediently, the link or coupling is constructed to be adjustable in terms of its length and, if appropriate, also in terms of its point of articulation. In one proposal, the link or coupling includes two parts formed as threaded bolts with a left-hand and a right-hand thread, and a nut which connects the bolts and which likewise has a left-hand and a right-hand thread. In another proposal, the link or coupling is adjustable via a rotatable, but fixable eccentric bolt. Other embodiments may, of course, also be envisioned.

As a result of the coupling of the printing unit guard and ink fountain, it is possible to provide a sensor which detects the throw of the ink fountain on the ink fountain roller and therefore also the position of the printing unit guard. A switching logic may be connected to this sensor, too, and, in the detected positions, clears the printing unit for printing or for a printing plate change or for a maintenance and cleaning mode.

In a further possibility for linking the mechanism of the vertical guides to the mechanism for providing the printing unit guard with the capability of being pivoted away, the guides are connected to the printing unit via pivot bearings. This embodiment, too, can be linked to the developments which were described with regard to the aforementioned embodiment.

Telescopic guides may also be provided as guides. It is possible, furthermore, for two lateral support plates to serve for stabilizing the telescopic guides.

Other features which are considered as characteristic for the invention are set forth in the appended claims.

Although the invention is illustrated and described herein as embodied in an adjustable suspension for a printing unit guard, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
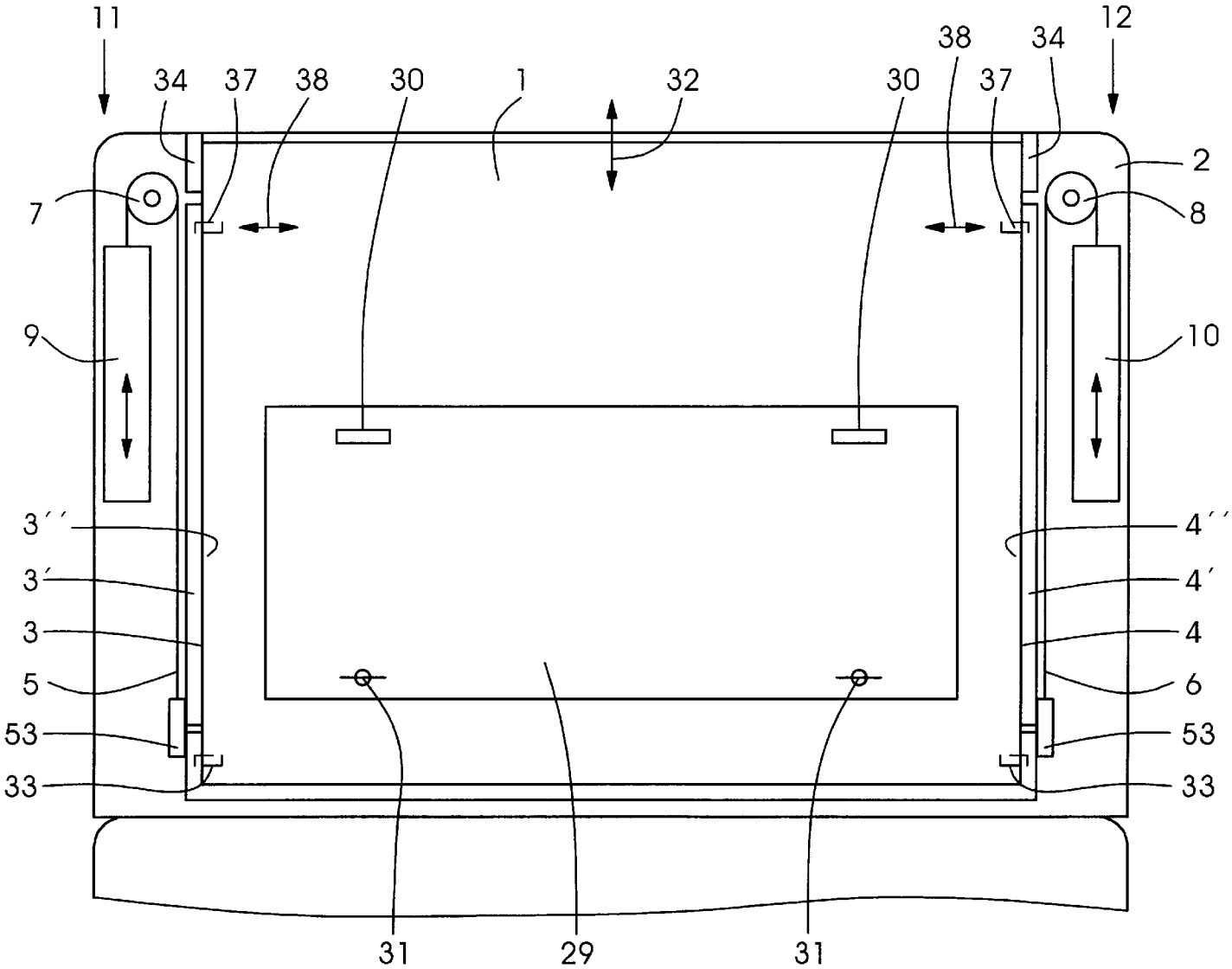
FIG. 1 is a front elevational view of an exemplary embodiment of the adjustable suspension for a printing plate changer.

Referring now to the drawings and, first, particularly to FIG. 1 thereof, there is shown therein a printing unit 2 with a first exemplary embodiment of an adjustable suspension for a printing plate changer 1. Suspensions 53 for two rope or chain pull assemblies 5 and 6 are located on the printing plate changer 1 on both sides, in a lower region thereof, as viewed in the figure. Deflecting rollers 7 and 8, respectively, are arranged, one on the drive side 11 and the other on the operator side 12 in an upper region of the printing unit 2. The rope or chain pull assemblies 5 and 6 are guided via the deflecting rollers 7 and 8, and counterweights 9 and 10 are arranged at the ends of the respective assemblies. The counterweights 9 and 10 are counterbalanced with the weight of the printing plate changer 1, in such a way that vertical adjustment of the printing plate changer 1 is possible virtually without any force being exerted, and the printing plate changer 1 remains standing in any position into which it is pushed. The adjusting movement for vertical adjustment is indicated by the double-headed arrow 32.

For this vertical adjustment, the printing plate changer 1 is guided in a guide 3 on the drive side 11 and in a guide 4 on the operator side 12. In the exemplary embodiment illustrated, these guides 3 and 4 are constructed so that fixed guide parts 3' and 4' are connected to the printing unit 2. The displaceable guide parts 3" and 4" running in the fixed guide parts 3' and 4' are connected to the printing plate changer 1.

Figure 3:
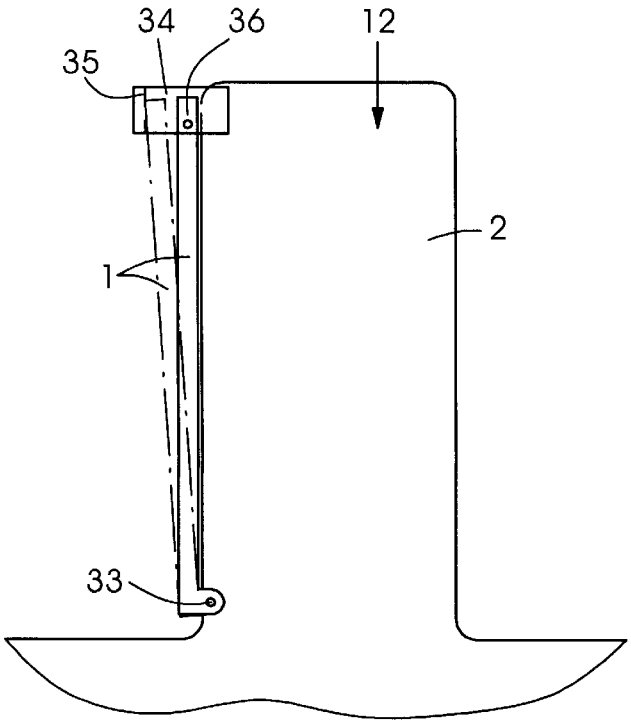
FIG. 3 is a fragmentary diagrammatic side elevational view of a pivotable printing plate changer.
Figure 4:
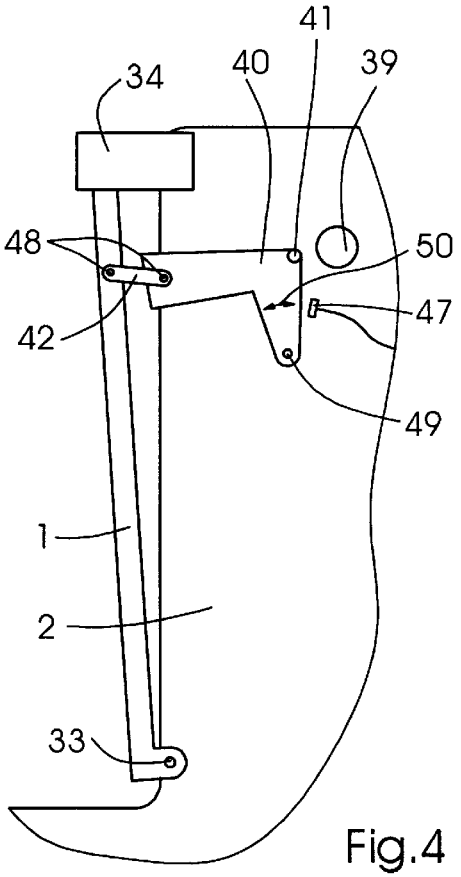
FIGS. 4 and 5 are views similar to that of FIG. 3 of an exemplary embodiment, in different operating phases, provided with a coupling between the printing plate changer and an ink fountain or duct.

So that the inking unit can be cleaned, maintained and filled with new ink, it is necessary for the ink fountain or duct 40 to be moved away, for example pivoted away, from the ink fountain roller 39 (FIG. 4). In this regard, the ink fountain 40 extends from the printing unit 2 on the front side of the latter. There is provision for mounting the printing plate changer 1 on both sides at the lower end thereof by pivot bearings 33 which allow the printing plate changer 1 to be pivoted away in order to provide space for the emergence of the ink fountain 40, and permit it to perform the necessary work on the inking unit. Located at the upper end of the printing plate changer 1, on both sides thereof, are support plates 34 which stabilize and guide the printing plate changer 1 when it is being pivoted out. Stops 35 may be arranged on the support plates 34 (FIG. 3) for limiting the distance pivoted away by the printing plate changer 1 and for holding the latter in the pivoted-away position.

In the embodiment illustrated in FIG. 1, vertical guides 3 and 4 and the pivoting-away mechanism 33, 34 and 35 are combined with one another as follows: the fixed guide parts 3' and 4' are connected fixedly to the printing unit 2. The displaceable guide parts 3" and 4" run in the latter. The printing plate changer 1 is connected at the lower end thereof to the displaceable guide parts 3" and 4" by pivot bearings 33. At the upper end, the connection between the displaceable guide parts 3" and 4" and the printing plate changer 1 is made by detaining devices 37. These may be formed as displaceable bolts 13 and 14, shown in greater detail in FIG. 2. The Double-headed arrows 38 indicate the locking and unlocking of the bolts 13 and 14. A sensor 15 can detect the engagement position.

The operation is as follows: for the vertical displacements (double-headed arrow 32) of the printing plate changer 1, the latter remains firmly connected to the displaceable guide parts 3" and 4" via the pivot bearings 33 and the detaining devices 37. When the printing plate changer 1 is to be pivoted away for work on the inking unit, the vertical guide 3, 4 is first moved into the lower position. The detaining device 37 is opened and the pivoting operation can take place. There is also provision, in an expedient development, for the printing plate changer 1 and the ink fountain 40, which has to be moved away from the inking roller 39 for work on the inking unit, to be connected to one another by links or couplings 42. The two adjusting movements can thereby be performed simultaneously and without the risk of collision. This is also explained in greater detail herein with reference to FIGS. 4 and 5.

FIG. 1 shows, furthermore, a servicing flap 29, the purpose of which is to ensure rapid access to the printing unit 2 for servicing work which is to be carried out quickly. Such a servicing flap 29 may, of course, also serve for performing work on the printing plate changer 1 itself, for example when the transport of a printing plate does not run perfectly. The method of mounting the servicing flap 29 is shown merely by way of example; it is articulated at the top by two hinges 30 and equipped at the bottom with two fastenings 31, for example quarter-turn fastenings. In the swung-up state, it can be attached in the upper region of the printing plate changer 1.

Figure 2:
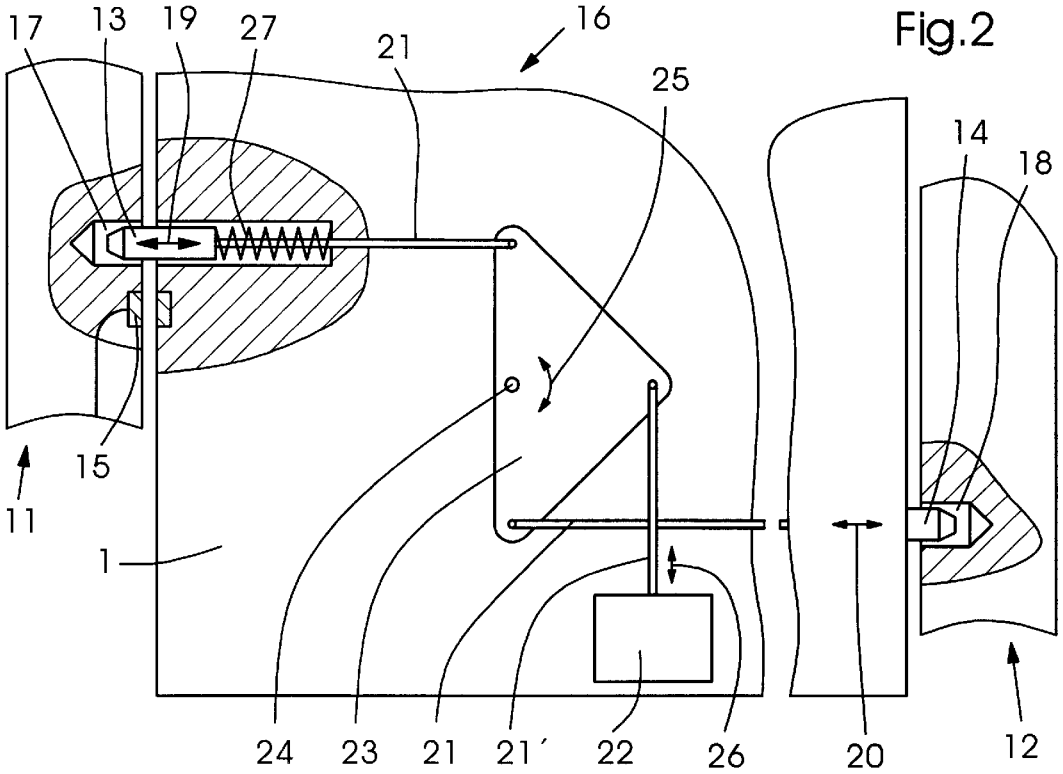
FIG. 2 is a fragmentary side elevational view of FIG. 1, partly broken away and in section, showing a detaining device formed as a locking bolt acting on both sides of the printing plate changer.

FIG. 2 shows an example of a detaining device with locking bolts 13 and 14 acting on both sides. Such detaining devices may be used at any desired locations for detaining the printing plate changer 1 in all the possible positions of the vertical adjustments thereof. Positions of the pivoting movement may, of course, also be detained in this way. Detention in the position for changing the printing plate is particularly important, however, because this position has to be particularly exact and stable.

The locking bolts 13 and 14 are mounted in the printing plate changer 1 and, in a locking position, are drivable into bolt engagement members 17 and 18 of the printing unit 2 or of a part connected to the latter. The double-headed arrows 19 and 20 show the actuating directions. A sensor 15 detects the locking position. A drive element 22 can thereby be activated in order to perform the locking. For this purpose, an actuating rod 21' is pulled downward for unlocking and pushed upward for locking in the direction of the double-headed arrow 26. The actuating rod 21' engages with a transmission element 23 which is mounted pivotably about a center 24 of rotation. This pivoting movement is indicated by the curved double-headed arrow 25. Two actuating rods 21, which lead to the respective locking bolts 13 and 14, are articulated on the transmission element 23. The respective lever arms are dimensioned according to the necessary forces. Springs 27 may be arranged between the actuating rods 21 and the respective locking bolts 13 and 14 for applying force to the locking bolts 13 and 14, so that the latter, even after the adjusting movements 26 and 25 have been performed, can still find their way by slight movements of the printing plate changer 1, even when the position is not yet exactly correct. For this purpose, it is also beneficial if the locking bolts 13 and 14 are formed with chamfers at the front end thereof. Such springs 27 and chamfers on the locking bolts 13 and 14 are expedient particularly for manual adjustments.

The locking mechanism may, of course, also be manually actuatable or be constructed so that it is located outside the printing plate changer 1, and the locking bolts 13 and 14 engage from outside into respective bolt engagement members 17 and 18 of the printing plate changer 1. Other drives, such as electromagnetic, pneumatic or the like, may also be provided for locking bolts. Other types of locking, such as catches or engaging levers, are also possible.

FIG. 3 is a diagrammatic side view of a printing plate changer 1 capable of being pivoted away. The printing unit 2 is illustrated from the operator side 12. In this position illustrated by solid lines, the printing plate changer 1 is ready for the printing plate change or for the printing mode. For performing the aforedescribed work on the inking unit, the changer is pivoted into the position represented in phantom, i.e., by dot-dash lines. The pivot bearings 33 and the support plates 34 with the stops 35 serve this purpose. The latter may, of course, also be constructed differently, for example as an articulation of the printing plate changer 1 on the printing unit 2 by bars or chains. A sensor 36 detects the position in which the printing plate changer 1 bears on the printing unit 2. In the position illustrated by unbroken lines, which must be capable of being detained reliably, the printing mode and the printing plate change, as a rule, take place. For further details, reference is made to the other illustrations.

Figure 5:
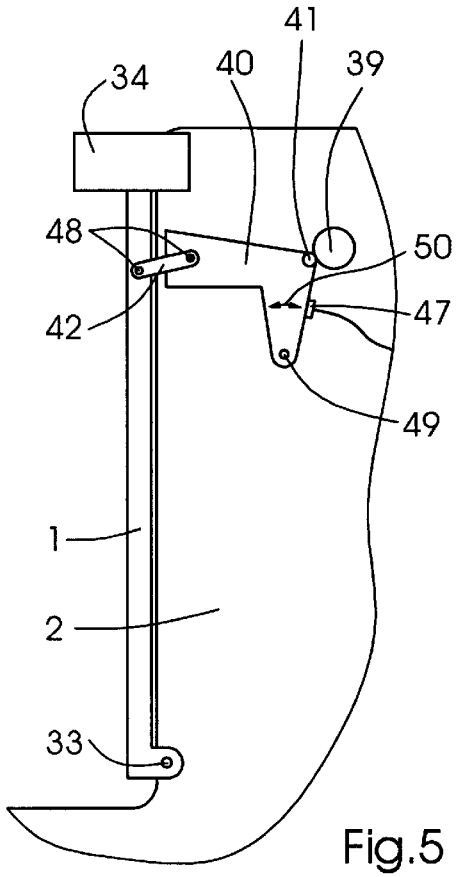

FIGS. 4 and 5 show an exemplary embodiment with a coupling between the printing plate changer 1 and the ink fountain or duct 40. In this regard, FIG. 4 shows the printing plate changer 1 in the pivoted-away position thereof, and FIG. 5 shows it in the position in which the printing plate changer 1 bears on the front side of the printing unit 2.

FIGS. 4 and 5 illustrate the ink fountain 40, the metering elements 41 and the ink fountain roller 39. In the normal printing mode, these assume the positions shown in FIG. 5, in which the ink is transferred from the ink fountain 40 by metering elements 41 onto the ink fountain roller 39 (also called an ink duct roller). The ink passes therefrom, via the inking unit, the plate cylinder and the rubber blanket cylinder, onto the sheet to be printed. At the end of a printing job or order, but, above all, when the ink has to be changed, it is necessary for the ink fountain 40 to be thrown off from the ink duct roller 39. The ink fountain 40 and the metering elements 41 are cleaned, and the inking unit is washed, or the ink still present is disposed of by being printed onto waste paper.

When the ink fountain 40 is thrown off from the ink duct roller 39, the ink fountain 40 emerges from the front side of the printing unit 2, and it is therefore necessary for the printing plate changer 1 to be moved away from this region. The pivoting away, previously illustrated in FIG. 3, of the printing plate changer 1 serves this purpose. Because these adjusting movements, that is to say the movement of the ink fountain 40 away from the ink duct roller 39, and the pivoting away of the printing plate changer 1, must both be performed, it is expedient for these movements to be connected to one another by providing at least one link or coupling 42, so that the operator has to perform only one adjusting operation, and a collision is ruled out. In the exemplary embodiment illustrated, the link or coupling 42, preferably one each being arranged, respectively, at both ends, that is to say on the operator side 12 and the drive side 11, is connected to the printing plate changer 1 and the ink fountain 40, respectively, by a coupling joint 48. When the printing plate changer 1 is pivoted about the pivot bearings 33, pivoting of the ink fountain 40 about a pivot axis 49 in the direction of the double-headed arrow 50 takes place simultaneously. At the same time, the ink fountain is thrown off from the ink duct roller 39. Moreover, a sensor 47 is provided, that detects the position of the ink fountain 40 and, consequently, of the printing plate changer 1. The signal from this sensor 47 is processed in the aforedescribed manner.

Figure 6:
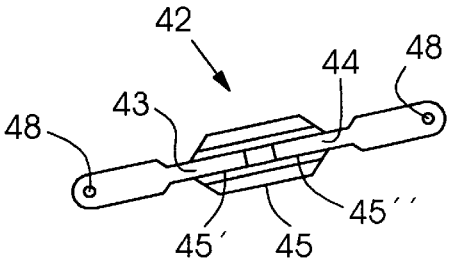
FIGS. 6 and 7 are enlarged plan views of two different embodiments of the coupling shown in FIGS. 4 and 5.
Figure 7:
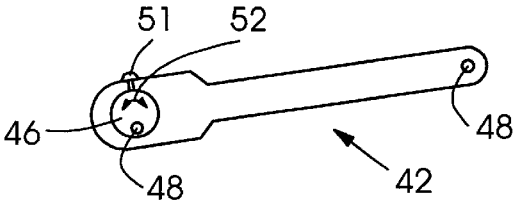

FIGS. 6 and 7 show two embodiments of a link or coupling 42. For the satisfactory functioning of the embodiment illustrated in FIGS. 4 and 5, it is necessary to set the link or coupling 42 so that the adjusting movements of the printing plate changer 1 and the ink fountain or duct 40 are correctly coordinated with one another.

FIG. 6 therefore proposes to construct a link or coupling 42 in two parts, each part having a coupling joint 48 and a threaded bolt 43, 44, one with a right-hand thread and the other with a left-hand thread. The two threaded bolts 43 and 44 are connected to one another by a nut 45 which likewise has a right-hand thread 45" in one half and a left-hand thread 45' in the other half thereof. Thus, the length of the link or coupling 42 can be adjusted by rotating the nut 45, and an appropriate setting or adjustment can thereby be performed.

FIG. 7 shows another embodiment of a link or coupling 42, in which one of the coupling joints 48 is mounted eccentrically in an eccentric bolt 46. By rotating the eccentric bolt 46, the effective length of the link or coupling 42 can likewise be adjusted for suitable setting purposes. The setting can be fixed by a locking screw 51.

Of course, the adjustable links or couplings which have been described hereinbefore, like all the other concrete solutions described herein, are merely by way of example. The basic solutions illustrated thereby can be implemented by many concrete forms.

We claim:

1. An adjustable suspension, comprising:

a printing unit;

a printing unit guard on said printing unit formed as a printing plate changer to be detained in a position for the printing plate changer, said printing unit guard having two sides, and guides;

at least one rope connected to each of said respective sides, for performing an adjusting movement;

at least one counterweight connected to said at least one rope, said counterweight having a mass calibrated for a virtually force-free adjustment of the printing unit guard; and at least one deflecting roller respectively supporting each of said at least one rope between said side and said at least one counterweight.

2. The adjustable suspension according to claim 1, wherein said one rope, said one deflecting roller and said one counterweight are arranged, respectively, both on the drive side and on the operator side of the printing unit.

3. The adjustable suspension according to claim 1, wherein the printing unit guard is detainable in at least one standby position.

4. The adjustable suspension according to claim 1, wherein the printing unit guard is manually adjustable, the taring of the counterweight mass being such that the printing unit guard is able to dwell in any desired position.

5. The adjustable suspension according to claim 1, including at least one locking bolt on at least one of the drive side and the operator side of the printing unit guard, and at least one sensor for detecting a detention position of the guard and for activating a locking mechanism for said locking bolt.

6. The adjustable suspension according to claim 1, wherein the printing unit guard is equipped with at least one servicing flap for accessing a performance of maintenance and cleaning work on at least one of the printing unit and a printing plate changer.

7. The adjustable suspension according to claim 1, including a pivot bearing on the printing unit guard, the printing unit guard being articulated at a lower end thereof on the printing unit by said pivot bearing and being pivotable, with an upper region thereof, such a distance away from the printing unit that it is possible for an inking unit thereof to be cleaned and maintained when the ink fountain of the inking unit is thrown off from an ink duct roller of the inking unit.

8. The adjustable suspension according to claim 7, including a sensor provided for detecting the pivoted-away printing unit guard.

9. The adjustable suspension according to claim 7, including at least one support plate for stabilizing the upper region of the printing unit guard.

10. The adjustable suspension according to claim 7, including a stop for limiting pivoting-away of the printing unit guard.

11. The adjustable suspension according to claim 7, including fixed guide parts connecting the guides, via pivot bearings located at the bottom thereof and via releasable detaining devices disposed in an upper region thereof, to the printing unit.

12. The adjustable suspension according to claim 7, including at least one coupling connecting the printing unit guard to the ink fountain for pivoting the printing unit guard conjointly with an adjustment of the ink fountain.

13. The adjustable suspension according to claim 12, wherein said coupling is adjustable.

14. The adjustable suspension according to claim 13, wherein said coupling includes two parts formed of threaded bolts with a left-hand and a right-hand thread, and of a nut connecting the threaded bolts, said nut likewise having a left-hand and a right-hand thread.

15. The adjustable suspension according to claim 13, wherein said coupling is adjustable via a rotatable, yet fixable eccentric bolt.

16. The adjustable suspension according to claim 12, including a sensor for detecting a throw of the ink fountain on the ink duct roller and also the position of the printing unit guard therewith.

17. The adjustable suspension according to claim 7, wherein the guides are connected to the printing unit via pivot bearings.

* * * * *

UNITED STATES PATENT AND TRADEMARK OFFICE

CERTIFICATE OF CORRECTION

PATENT NO. : 6,142,072
DATED : November 7, 2000
INVENTOR(S) : Stephan Rudzewitz et al.

It is certified that error appears in the above-identified patent and that said Letters Patent is hereby corrected as shown below:

Title page,
Item [75] should read as follows,
-- Stephan Rudzewitz, Walldorf; Rüdiger Böhm, Schwetzingen, both of Germany --

Signed and Sealed this

Twenty-fifth Day of December, 2001

*Attest:*

*Attesting Officer*

JAMES E. ROGAN
*Director of the United States Patent and Trademark Office*